United States Patent [19]

Kresin

[11] Patent Number: 4,577,775

[45] Date of Patent: Mar. 25, 1986

[54] CUP-SHAPED CONTAINER

[75] Inventor: Hermann Kresin, Bergneustadt, Fed. Rep. of Germany

[73] Assignee: Gizeh-Werk GmbH, Bergneustadt, Fed. Rep. of Germany

[21] Appl. No.: 679,949

[22] Filed: Dec. 10, 1984

[30] Foreign Application Priority Data

Dec. 10, 1983 [DE] Fed. Rep. of Germany ..... 3344779

[51] Int. Cl.[4] ..... B65D 41/20

[52] U.S. Cl. ..... 220/66; 220/72; 229/1.5 B

[58] Field of Search ..... 220/66, 69, 70, 72; 229/1.5 B, 5.5, 5.8

[56] References Cited

U.S. PATENT DOCUMENTS

| | | | |
|---|---|---|---|
| 2,988,258 | 6/1961 | Witzke | 229/1.5 B |
| 3,070,257 | 12/1962 | Bojanowski | 220/66 |
| 3,098,597 | 7/1963 | Johnson et al. | 220/72 X |
| 3,557,995 | 1/1971 | Mirasol, Jr. et al. | 229/1.5 B X |
| 4,381,061 | 4/1983 | Cerny et al. | 215/1 |

FOREIGN PATENT DOCUMENTS

| | | | |
|---|---|---|---|
| 338164 | 8/1977 | Austria . | |
| 7312456 | 4/1973 | Fed. Rep. of Germany . | |
| 1454780 | 11/1976 | United Kingdom | 220/66 |

*Primary Examiner*—Steven M. Pollard
*Attorney, Agent, or Firm*—Holman & Stern

[57] ABSTRACT

In order to ensure, in a cup-shaped container, that the base can be pressed out in a trouble-free manner even with an economical use of materials and is sufficiently stable after moving from one position into another, radially extending groove- or rib-shaped profiles which converge to form a hollow central area are provided in the base. The height of the said profiles of the base advantageously decreases from the central area towards the outer ends of the profiles.

7 Claims, 7 Drawing Figures

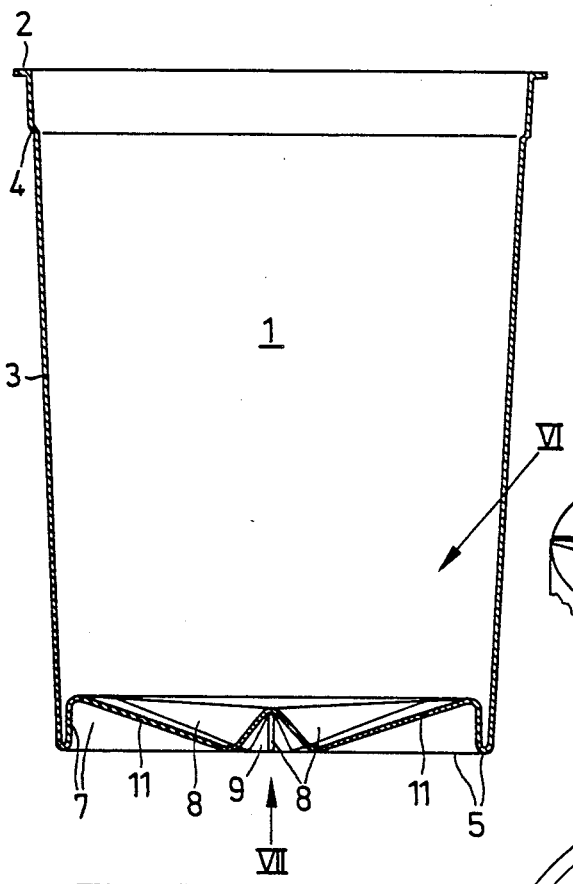
FIG. 5
FIG. 6
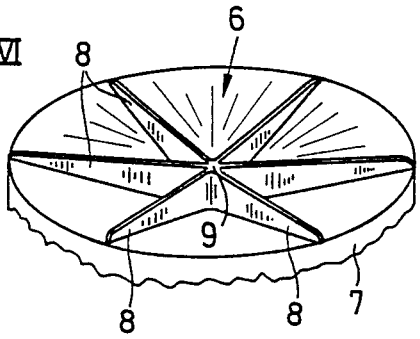
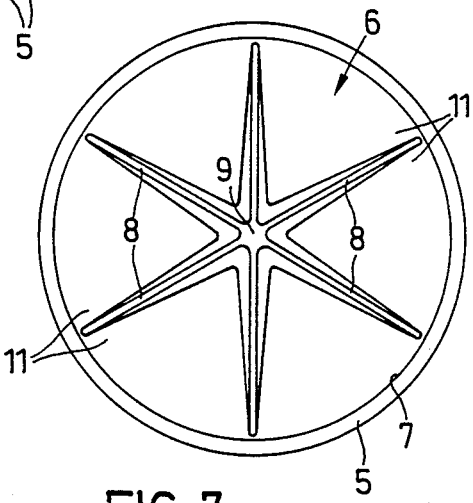
FIG. 7

CUP-SHAPED CONTAINER

BACKGROUND TO THE INVENTION

1. Field of the Invention

The invention relates to a cup-shaped container of plastics material of a substantially conical basic shape having a wall and a base which can be pressed out in the direction of the longitudinal axis of the container and in particular can be moved from a first end position into a second end position and vice versa, and having an edge part with a contact edge projecting downwards beyond the base.

2. Prior Art

Known containers of this type are used for example for holding dairy products, dessert preparations and the like and are closed after pouring in the substance to be packed. In this connexion the closure can, in particular, be in the form of a foil which consists of metal and/or plastics material and which can be secured to an upper rim of the container by sealing, adhesion or the like. In addition, there are also other possibilities for closing the filled container. In containers of this type which are used for packaging, a stacking edge or shoulder is frequently provided on the upper end thereof below the rim on which the closure foil is to be laid, but it can also be provided at another point, for example in the lower region.

Certain pourable substances, for example fruit preparations, desserts or the like are poured in a hot state. Since the container in question is closed immediately after filling, an underpressure subsequently arises in the closed container as a result of the cooling of the poured substance and possibly also caused by working of the later. On the other hand, there are also pourable substances which produce gases or whose volume increases to a certain extent after the container has been filled and sealed, as a result of which an overpressure is then produced in the sealed container. Both an overpressure of this type and an underpressure can have an adverse effect and lead to tearing of the closure, to buckling of the walls or to damage to the container.

In order to take account of this, containers have been proposed with deflectable bases. In a known embodiment of a cup (German Gebrauchsmuster 73 12 456) the base has concentric circular raised and recessed portions, so that a corrugated profile in the radial cross-section is produced, in order to form a deformable diaphragm. In this connexion the occurrence of uncontrolled or undesired deformations or displacements of the base of the cup cannot always be prevented. In addition, containers are known having a smooth base curved in a spherical shape which can be made to revert from one position to another in the manner of a snapping action. This, however, demands the application of a certain amount of force and requires a relatively robust construction of the base.

SUMMARY OF THE INVENTION

The object of the invention is provide a container of the type described above, in which the base is formed in a special manner in such a way that even with an economical use of materials it is possible to press it out in a trouble-free manner, that the base is sufficiently stable after passing from one position into the other, and that the practical requirements are met in an advantageous manner when material to be poured in a hot state is held. In this connection the invention further seeks to attain favorable values of the force to be applied when pressing out the base.

The invention provides that radially extending groove- or rib-shaped profiles or the like, which converge to form a hollow central area, are provided in the base.

A design of this type is characterized by a number of important advantages. Thus, inter alia, the base has on the one hand a stability sufficient to withstand the stresses in the individual positions, while on the other hand it can be deformed in such a way that the forces required for moving from one end position to the other remain within favorable limits. The end positions are largely defined, but not so rigidly that slight compensation movements desired under certain conditions cannot occur. In a preferred embodiment of the container the profiles are open towards the underside of the base. The invention also embraces an embodiment with profiles open towards the top, which may be advantageous in certain cases.

The profiles can have substantially the same height over their length. In a highly advantageous embodiment, however, the height of the profiles decreases from the central area towards the outer ends of the profiles. This further contributes to the favorable behavior of the base.

The profiles advantageously extend substantially to the outer boundary of the base, although a shorter length is not ruled out.

The number of the profiles can be selected in accordance with the requirements and conditions in question. At least six profiles are advantageously provided.

The portions of the base lying between the profiles are advantageously substantially flat or smooth.

A particularly advantageous solution to the problems described has been achieved by the invention in a surprising manner. A substantially increased surface and at the same time a reduced thickness of the base with the same amount of material used as compared with a normal base is made possible by the radial profiles, as a result of which the base has obviously become a part more susceptible to deformation than the wall, i.e. the sleeve of the container. In this way it is ensured that in the event of changes in the volume of the closed container the wall thereof will in fact remain free of deformations and only the base executes a movement in the manner intended. On account of the radial profiling this movement is such that optimum conditions are achieved.

In this connection the profiles act similarly to hinges or articulated joints between the individual portion of the base, as a result of which trouble-free conditions for the extension movement of the entire base are provided.

The fact that the base has these excellent properties and thus keeps the wall of the container undamaged during substantial changes in pressure in the interior, provides a further important advantage. It is therefore possible for the amount of plastics material required for producing the entire container to be kept absolutely less than was previously possible. In addition, in the case of a wall thickness of the container reduced as a whole, the base ramains the part reacting alone—as compared with the wall—to pressure changes by movement. In this way an economy in material is made possible in principle, which naturally has a favorable effect upon production costs and not least is also ecologically acceptable.

Thus the base can be kept relatively thin, as a result of which a saving in plastics material can be achieved. Where appropriate the base can also be kept thinner than the wall of the container.

The connection of the base to the wall or to a part of the edge can also be effected in various ways within the scope of the invention. Thus the base can pass directly into the wall in a region located above the contact edge. In a special embodiment the base continues in a part which is directed downwards and which in the region of the contact edge passes into the wall or edge part of the container. This further enhances the functioning of the base.

The container can in particular be produced by deep drawing. Production by injection molding, however, is not excluded.

Further details, features and advantages of the invention may be seen in the following description of one example of embodiment, in the accompanying drawing and in the claims.

BRIEF DESCRIPTION OF THE DRAWINGS

FIG. 5 is a longitudinal section corresponding to FIG. 1, the base being in its lower position;

FIG. 6 is a fragmentary perspective view of the base in its lower position as viewed in the direction of the arrow VI in FIG. 1; and FIG. 7 shows the base in its lower position as viewed from below in the direction of arrow VII in FIG. 5.

DETAILED DESCRIPTION OF PREFERRED EMBODIMENT

Figure 1:
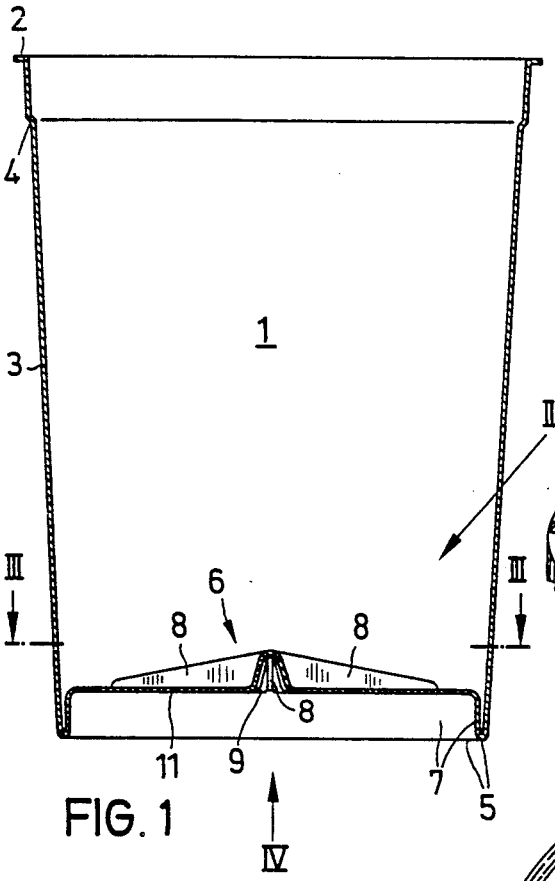
FIG. 1 shows a container in longitudinal section along the line I—I in FIG. 3, the base being in its upper position.

The container 1 illustrated is in the form of a cup with a substantially conical basic shape and is made from plastics material in accordance with the deep-drawing method. Its peripheral wall 3 has an upper rim 2 which forms a bearing surface for a closure foil secured for example by hot sealing. A shoulder 4, which in a known manner forms a stacking shoulder when a plurality of empty cups are to be stacked in one another, is provided in the wall 3 at a certain distance below the rim 2. The base of the container 1 is designated 6 as a whole. The wall 3 continuously extends further down beyond the level of the base 6 as far as a contact edge 5. As a variant of the arrangement illustrated the contact edge can also be formed on a special edge part which, although integral with the actual wall, is offset with respect to the wall for example by a step, a change in the cross-section, or the like, and can for example be cylindrical or can have a tapered section opposite the tapered section of the wall.

In the example of embodiment shown, the base 6 continues in a part 7 which is directed downwards, is approximately cylindrical or slightly tapered, and passes into the wall 3 in the region of the contact edge 5. Another embodiment consists in the base being directly joined to the inside of the wall or edge part without an extension of this type.

Figure 2:
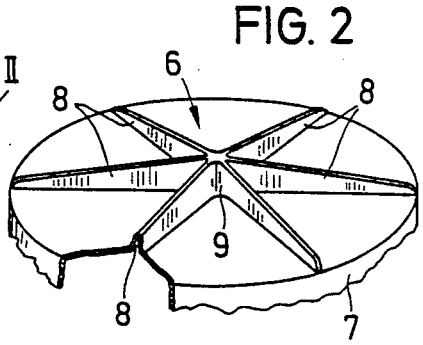
FIG. 2 is a fragmentary perspective view of the base in its upper position as viewed in the direction of the arrow II in FIG. 1.

Radially extending profiles 8 are formed in the base 6, and appear as ribs on the upper side of the base and open grooves on the underside of the base, as shown in particular in FIG. 2. The profiles 8 converge in the center of the base 6 to form a hollow central area 9. They extend substantially to the outer boundary 10 of the base 6. Their height decreases from the central area 9 to the outer ends, as clearly illustrated in the drawing. In the case of the advantageous embodiments shown, six profiles 8 are provided, arranged in the shape of a star. The portions 11 of the base 6 lying between the profiles 8 are substantially flat. The thickness of the portions 11 and also of the profiles 8 can be relatively slight and also less than the thickness of the wall 3.

Figure 4:
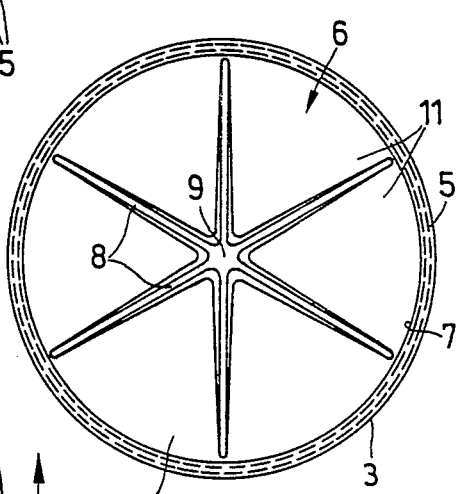
FIG. 4 shows the base in the upper position according to arrow IV in FIG. 1 as viewed from below.
Figure 3:
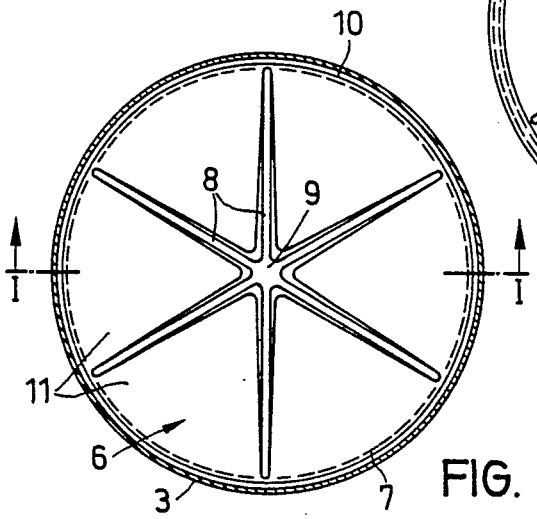
FIG. 3 is a plan view of the base corresponding to a section along the line III—III in FIG. 1.

If the container is to be filled with a hot substance, the initial state of the container is as shown in FIGS. 1 and 2, the base 6 therefore being in its upper end position. During the filling operation the base is loaded with the increasing weight of the substance being poured and is thus pressed downwards, until finally the lower end position according to FIGS. 5 and 6 is attained with a certain spreading of the profiles 8 with the central area 9. FIG. 7 shows the spreading of those regions as compared with FIG. 4. The movement of the base 6 takes place within the cavity enclosed by the lower part of the wall 3 or a corresponding edge part.

If the container is subsequently closed, an underpressure occurs in it as the contents cool. As a result of this underpressure the base 6 is raised again, until there is equilibrium with respect to the external pressure, without any parts of the container being adversely affected. In its upper end position the base 6 is sufficiently stable, but nevertheless has a certain resilience, so that even then changes in the pressure ratios can be absorbed. All this is achieved by virtue of the special design of the container, which provides good deformability in a substantially defined manner with moderate application of force and at the same time favorable stability.

All the features mentioned in the foregoing description or illustrated in the drawings should, as far as permitted by the known state of the art, be regarded as coming within the scope of the invention either individually or in combination.

I claim:

1. A plastic cup-shaped container having a longitudinal axis, a generally frustoconical peripheral wall, a base wall, and means providing for flexure of the base wall in the direction of the longitudinal axis between volume-increasing and volume-decreasing positions, the flexure providing means comprising radially extending folds in the base wall projecting from a common central depression toward the periphery of the base wall and triangular base wall panels connecting adjacent folds for providing opening and closing of the folds when the base wall is flexed between said positions.

2. The invention of claim 1 wherein the folds are open towards the underside of the base wall.

3. The invention of claim 1 wherein the folds taper downwardly in height from said depression toward the periphery of the base wall.

4. The invention of claim 1 wherein the folds extend substantially to the periphery of the base wall.

5. The invention of claim 1 wherein the folds are at least six in number.

6. The invention of claim 1 wherein said panels are substantially planar and absent reinforcing ribs.

7. The invention of claim 1 wherein the base wall is connected to the peripheral wall by a folded rim portion.

* * * * *